US005275503A

United States Patent [19]

Lewis et al.

[11] Patent Number: 5,275,503

[45] Date of Patent: Jan. 4, 1994

[54] PAVING AND TILING

[76] Inventors: Richard Lewis, 9 Church Street, Tideswell, Derbyshire SK17 8PE, United Kingdom; Judith Richards, The Bulls Head, Tideswell, Derbyshire SK17 8NU, United Kingdom

[21] Appl. No.: 842,145

[22] PCT Filed: Oct. 9, 1990

[86] PCT No.: PCT/GB90/01550

§ 371 Date: May 14, 1992

§ 102(e) Date: May 14, 1992

[87] PCT Pub. No.: WO91/05914

PCT Pub. Date: May 2, 1991

[30] Foreign Application Priority Data

Oct. 10, 1989 [GB] United Kingdom ..... 8922804

[51] Int. Cl.[5] ..... E01C 5/00

[52] U.S. Cl. ..... 404/42

[58] Field of Search ..... 404/41, 42

[56] References Cited

U.S. PATENT DOCUMENTS 708,470 9/1902 Flood ..... 404/42 X 4,711,599 12/1987 Glickman ..... 404/42 X

FOREIGN PATENT DOCUMENTS 2407621 8/1975 Fed. Rep. of Germany ..... 404/42

2012332 7/1979 United Kingdom ..... 404/42

*Primary Examiner*—William P. Neuder

*Attorney, Agent, or Firm*—Trexler, Bushnell, Giangiorgi & Blackstone, Ltd.

[57] ABSTRACT

The invention relates to paving blocks or tiles or to wall tiles, and has for its objective to provide a block or tile shape giving substantial freedom to a designer in providing any one of a considerable number of available patterns employing numbers of blocks or tiles of the same size. This objective is met by a construction comprising a generally rectangular body (2) having two generally parallel sides (3) and two ends each formed by two curved surfaces (3, 5) one end being formed by two equally and oppositely curved convex surfaces (4) that meet on the general center plane of the block or tile, and the other end being formed by two equally and oppositely curved concave surfaces (4) that meet on the general center plane of the block or tile (1), all the curved surfaces being of the same curvature.

3 Claims, 2 Drawing Sheets

PAVING AND TILING

This invention relates to paving and tiling.

Paving as a means of providing an acceptable surface for use by pedestrians and traffic has long been known, in the form of paving tiles or slabs traditionally used for pedestrian areas, pavements and the like, and in the form of so-called cobblestones, traditionally used for both pedestrian areas and road surfaces.

The increasing provision of traffic-free pedestrian areas has caused increased attention to the visual effect of a paved or cobblestoned area, and with conventional square or rectangular paving slabs or cobblestones, whilst some variation of pattern and hence surface effect is possible, the number of variations that are possible is very small.

This has led in some instances to first the designing of a desired pattern for a paved or cobblestoned area, and then the production of paving slabs or cobblestones of particular shapes to enable them to be laid to create the required pattern and hence visual effect. This is obviously inconvenient and expensive.

In other instances, it has led to consideration being given to the creation of shapes of, particularly, paving slabs, and where paving slabs of one or a small number of different shapes can be laid side-by-side with a large number of variations of pattern and hence visual effect, than is permitted by conventional square or rectangular shapes, and it is the object of the present invention to provide such shapes.

Equally well-known is the tiling of walls and floors to provide a hard wearing surface of pleasing aesthetic effect. Predominantly, such tiles are square or rectangular, relying on a surface pattern on the tiles to create the desired visual appearance.

According to the present invention, a block or tile comprises a body having each of its ends formed by two equally and oppositely curved surfaces that meet on the general center plane of the body, and generally parallel side surfaces to the body extending between the outer end of the curved surfaces, with one end of the block or tile formed by two equally and oppositely curved convex surfaces, the junctions between the side surfaces and the equally and oppositely curved concave end surfaces to the opposite end lie respectively on a projection of the arcs forming the convex surfaces.

Thus the block or tile of the invention has a generally chevron-like appearance and blocks and tiles can be placed in side-by-side and end-to-end relationship to generate a multiple number of patterns.

Most desirably the operative surface of the block or tile can be patterned or decorated in such a manner that the pattern or decoration on one block or tile blends with the pattern or decoration on an adjacent tile to enhance the appearance generated by the blocks or tiles. Thus, for example, the surface of a block can be patterned to simulate a number of small cobblestones, the simulated cobblestones to each side of a block may be of an arcuate pattern curved in the same direction as the convex and concave surfaces to that side of the block. Thus, an arcuate pattern of one block is continued by the arcuate pattern on an adjacent block to further enhance the appearance.

Particularly with blocks, it is further preferred to form the two sides with castellations that interfit with the castellations on the sides of adjacent blocks, to mask the joint between adjacent blocks, which castellations may be created by simulated cobblestones when provided as the pattern on the surface.

To provide a variety of patterns, a variety of generally rectangular shapes can be provided. Thus a block or tile based on a square can be employed to produce a regular pattern. Alternatively a rectangular shape where the ends are longer than the sides to create a laterally elongate or stretched pattern can be employed. Equally a rectangular shape where the sides are longer than the ends can be employed to create a longitudinally elongate or squashed pattern.

Several embodiments of the invention will now be described by way of example, with reference to the accompany wings, in which.

Figure 1:
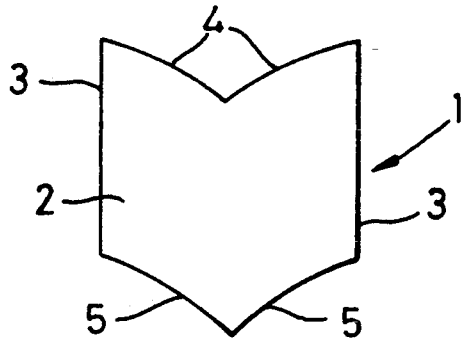
FIG. 1 shows a block or tile in accordance with the invention.

In the drawings, a block or tile 1 comprises a generally rectangular body 2 with two generally parallel sides 3. To one end, two convex surfaces 4 are provided that meet generally centrally of the block or tile, and to the opposite end, two concave surfaces 5 are provided that again meet generally centrally of the block or tile.

Figure 2:
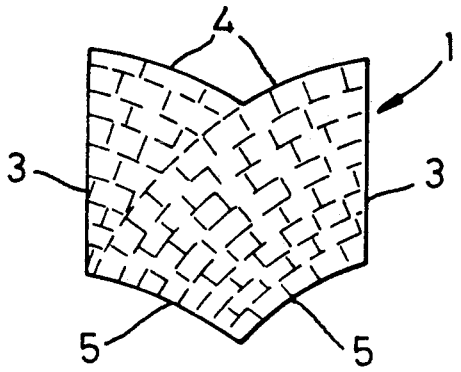
FIG. 2 shows the block of FIG. 1 with an indication of a suitable surface pattern.

The surface of the block or tile can be plain, but can equally be provided with any required pattern or surface effect. Thus, as shown in FIG. 2, the surface can be formed to simulate a number of cobblestones when it is a block to be laid and form a surface for use by pedestrians or traffic. To heighten the visual effect, and as is illustrated, the lines of simulated cobblestones are curved to follow the curvature of the ends of the block or tile, and when the curved pattern of one block or tile is continued by the curved pattern on an adjacent block or tile.

Figure 3:
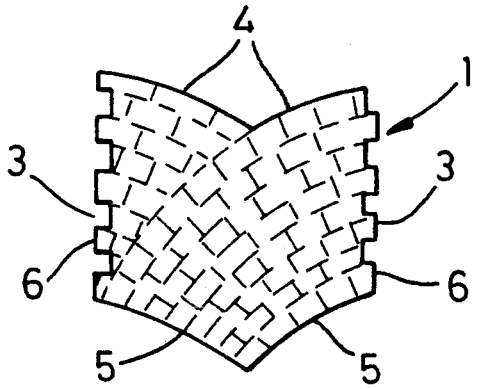
FIG. 3 shows the block of FIG. 2 with castellated sides.

As is shown particularly by FIG. 3, the sides 3 of the block or tile can be provided with castellations 6 to assist in the location of adjacent blocks or tiles in side-by-side relationship.

By providing a requisite number of identical blocks or tiles, such as of the particular configurations exemplified in FIGS. 2 and 3, a truly considerable number of different patterns are available to a designer. Thus, and purely by way of example, FIGS. 4 to 6 show three patterns available when using the blocks of either of FIGS. 2 or 3.

Figure 4:
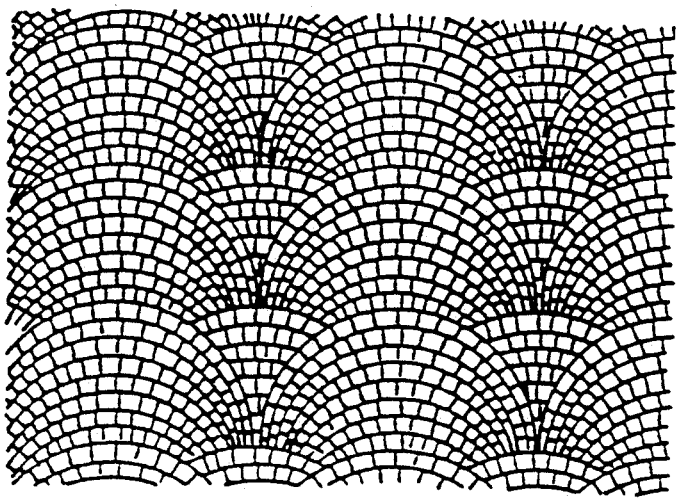
FIGS. 4 to 6 are typical representations of the various patterned effects available when using the blocks or tiles of the invention.
Figure 5:
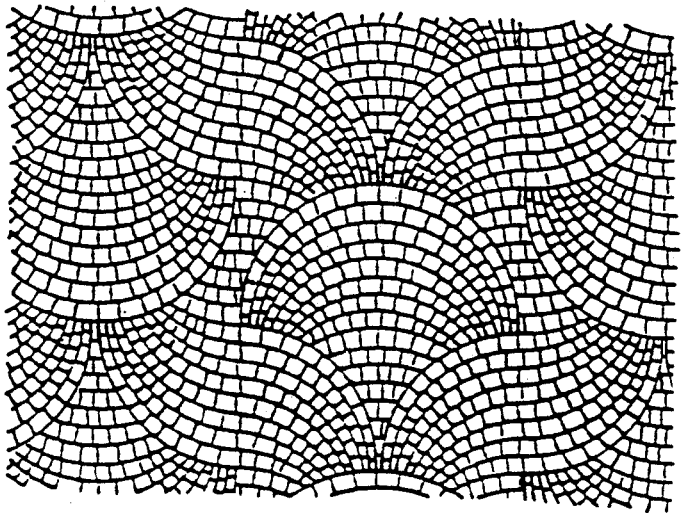
Figure 6:
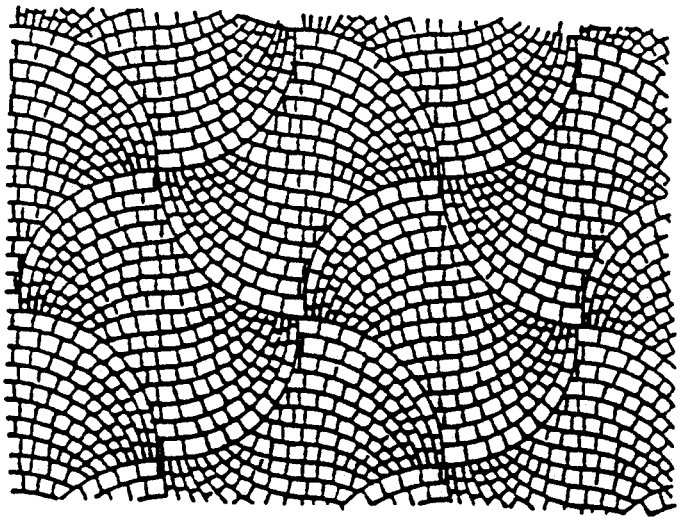

It will be understood that in addition to the cobblestone effect illustrated in FIGS. 4 to 6, any textured or patterned effect can be formed or printed on the surface to suit the intended purpose of the blocks or tiles and to suit the requirements of the designer or user of the surface formed by the blocks or tiles.

We claim:

1. A block or tile comprising a body having each of its ends formed by two equally and oppositely curved surfaces that meet on the general center plane of the body, and generally parallel side surfaces to the body extending between the outer end of the curved surfaces, characterised in that with one end of the block or tile (1) formed by two equally and oppositely curved convex surfaces (4), the junctions between two side surfaces (3) and the equally and oppositely curved concave end surfaces (5) to the opposite end lie respectively on a projection of the arcs forming the convex surfaces (4) and further characterised in that each side surface is formed with interlocking formations (6) in the form of castellations, said castellations to one side of said block or tile (1) being staggered in relation to said castellations to the other side and whereby a projection on one side surface is co-planar with a recess on the other side surface.

2. A block or tile as in claim 1, characterised in that the operative surface of the block or tile (1) is patterned or decorated in such a manner that the pattern or decoration on one block or tile blends with the pattern or decoration on an adjacent tile to enhance the appearance generated by the blocks or tiles.

3. A block or tile as in claim 3, characterised in that the surface of the block or tile (1) is patterned to simulate a number of small cobblestones, the simulated cobblestones in one sector of the block being arcuately disposed at the same radius of curvature and extend to the projection of one convex surface (4) and on which the opposite corner of the block or tile to the opposite end lies, and in a second sector the simulated cobblestones are arcuately disposed at the same radius or curvature of the second convex face (4) at said one end of the block or tile and extends to meet the innermost arcuate line of simulated cobblestones in said first sector of said block or tile (1).

* * * * *